United States Patent [19]

La Fever

[11] 4,383,471

[45] May 17, 1983

[54] WEAPON CHARGER

[75] Inventor: Clifford E. La Fever, Mission Viejo, Calif.

[73] Assignee: The United States of America as represented by the Secretary of the Army, Washington, D.C.

[21] Appl. No.: 241,915

[22] Filed: Mar. 9, 1981

[51] Int. Cl.[3] ..... F41F 19/16

[52] U.S. Cl. ..... 89/1 K

[58] Field of Search ..... 89/1 K

[56] References Cited

U.S. PATENT DOCUMENTS

| | | | |
|---|---|---|---|
| 1,897,099 | 2/1933 | Woody et al. | 89/1 K |
| 2,717,532 | 9/1955 | Ramseyer | 89/1 K |
| 2,810,325 | 10/1957 | Deslierres et al. | 89/1 K |
| 3,044,361 | 7/1962 | Lizza | 89/1 K |
| 3,566,744 | 3/1971 | Stoner | 89/1 K X |
| 4,261,247 | 4/1981 | Reynolds | 89/1 K X |

*Primary Examiner*—David H. Brown

*Attorney, Agent, or Firm*—Nathan Edelberg; Robert P. Gibson

[57] ABSTRACT

A charger for a weapon operates on a carrier having a forward facing shoulder. The charger includes a rod having a longitudinal depression, mounted in the weapon. Also included is a charger block slidably mounted about the rod. The charger block has a lateral passage reaching the rod. The charger also includes a key mounted in the lateral passage. The key is operable to engage the shoulder. This key is inwardly moveable upon reaching the depression of the rod to disengage the shoulder.

10 Claims, 8 Drawing Figures

WEAPON CHARGER

GOVERNMENT INTEREST

The invention described herein may be manufactured, used and licensed by or for the government, for governmental purposes without payment to me of any royalties thereon.

BACKGROUND OF THE INVENTION

The present invention relates to weapon chargers and, in particular, to a charger driven by a block that can backwardly translate after a bolt carrier ceases moving.

Bolt carriers of known guns can be retrogressed by a chain-driven charging block. A problem with this known arrangement is that the bolt carrier can fully retrogress and engage stops while the drive chain is still attempting to move the carrier. A continuing pull by the drive chain can be caused by the inertia of the chain or by late disabling of the motor pulling the chain.

Therefore, there is a need for a drive mechanism that has limited motion after a bolt carrier stops, in order to reduce stresses.

SUMMARY OF THE INVENTION

In accordance with the illustrative embodiment demonstrating features and advantages of the present invention, there is provided a charger for a bolt carrier of weapon. This carrier has a forward facing shoulder. The charger includes a rod having a longitudinal depression, mounted in the weapon. The charger also has a charging block and a key. The charging block is slidably mounted about the guide rod and has a lateral passage reaching the rod. The key is mounted in the lateral passage. The key is operable to engage the shoulder and is inwardly movable, upon reaching the depression of the rod, to disengage the shoulder.

The present invention provides a charger for a bolt carrier of a weapon, having a drive means and an indexing means. The drive means can backwardly urge the bolt carrier. The indexing means is coupled to the drive means and can engage and disengage the drive means with the carrier as a function of the longitudinal displacement of the drive means.

By employing apparatus of the foregoing type an efficient mechanism is offered, allowing retrogression and stopping of a bolt carrier without creating excessive stress in the drive mechanism. This stress is avoided since the bolt carrier can be driven by a block that continues to move after the bolt carrier is stopped and seared.

In a preferred embodiment, the charging block is formed of a saddle-shapped member having a pair of opposing passages into which are mounted opposing rollers. The rollers travel along opposite sides of the guide rod. The rollers are outwardly held by the rod so that they can engage shoulders on the bolt carrier to move it. When the rollers reach a depressed portion cut into the rod they move inwardly thereby disengaging the shoulders of the bolt carrier and moving with respect thereto. The rollers and their charging block can thus continue to move although the bolt carrier has stopped. Also, the guide rod is provided with a slot, which permits forward travel of the rod sufficient to allow said rollers to move out of the depressed portion cut into the rod when the bolt carrier is in the sear position.

BRIEF DESCRIPTION OF THE DRAWINGS

The above brief description as well as other objects, features and advantages of the present invention will be more fully appreciated by reference to the following detailed description of the presently preferred but the nonetheless illustrative embodiment in accordance with the present invention, when taken in conjunction with the accompanying drawings wherein.

DETAILED DESCRIPTION OF THE PREFERRED EMODIMENT

Figure 1:
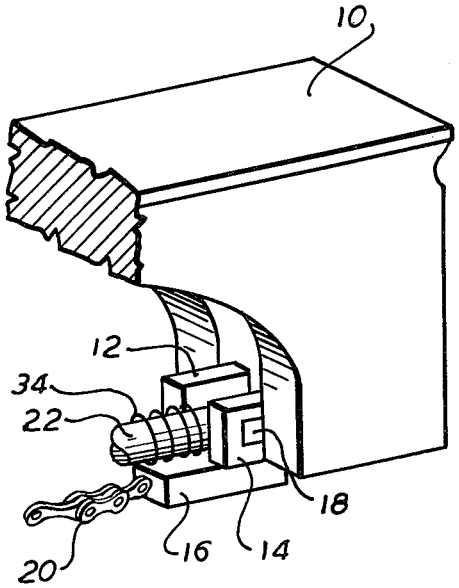
FIG. 1 is a perspective view of a weapon charger according to the present invention.
Figure 2:
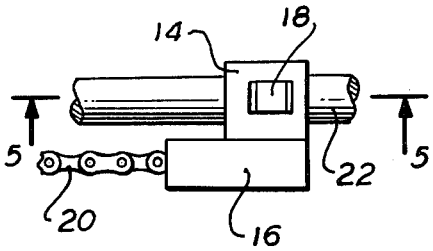
FIG. 2 is a side view of the charger of FIG. 1.
Figure 3:
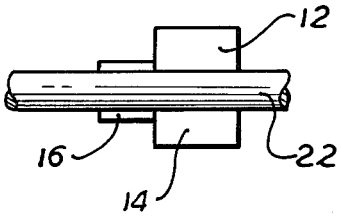
FIG. 3 is a top view of the charger of FIG. 2.

Referring to FIG. 1, a bolt carrier 10 is shown with its rear portion broken away for illustration purposes. In FIGS. 2 and 3 a side and top view, respectively, is given of the apparatus of FIG. 1, but with bolt carrier 10 removed to clarify the illustration. The illustrated portion of bolt carrier 10 is essentially saddle-shaped. Bolt carrier 10 straddles a drive means shown herein as a charging block comprising a pair of spaced rectangular members 12 and 14 mounted on a lower rectangular block 16. Mounted in each of members 12 and 14 is a key, the one visible in these figures being depicted herein as cylindrical roller 18 contained in a lateral passage (or opening) in member 14. It is to be appreciated that member 12 has a similar roller and opening which is illustrated hereinafter. Mounted on the rear face of lower block 16 is drive chain 20 for backwardly urging the block connected to it. Members 12 and 14 are shown partially emerging from a corridor in carrier 10 and straddling an indexing means shown herein as charging block guide rod 22. Rod 22 is mounted in a frame 23 shown in cutaway section in FIG. 4.

Figure 4:
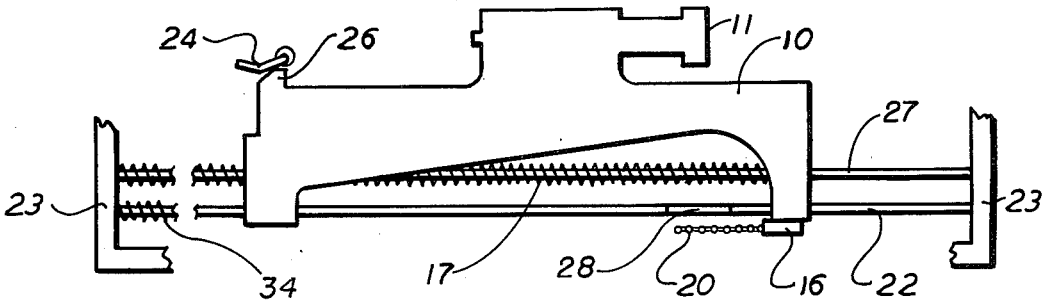
FIG. 4 is another side view of the apparatus of FIG. 1.

Referring to FIG. 4, previously illustrated bolt carrier 10 and rod 22 are shown more completely and on a reduced scale. In this view the charging block is shown partially hidden within the corridor of bolt carrier 10 so that only block 16 is visible. Bolt carrier 10 which is of a conventional type, contains a bolt 11 and is longitudinally reciprocatable along its guide rod 27 mounted in supporting frame 23. When the bolt carrier 10 is retrogressed a sufficient distance, sear 24, which is pivotally mounted in the frame 23, can ride over and engage the forward face of projection 26 to restrain bolt carrier 10, in a conventional manner.

In this embodiment rod 22 is cylindrical and has a longitudinal depression 28, which is a pair of flattened opposing surfaces on either side of rod 22. As illustrated, block 16 approaches depression 28 just as sear 24 approaches projection 26.

Figure 5:
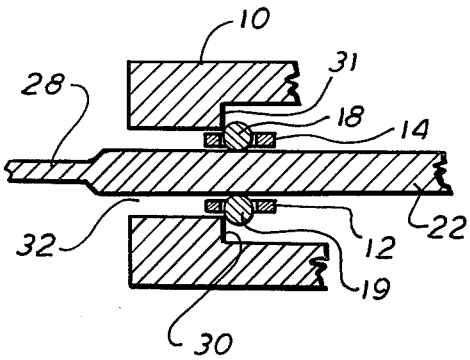
FIG. 5 is a sectional view along lines 5—5 of FIG. 2.

Referring to FIG. 5, a sectional view along line 5—5 of FIG. 2 is given showing bolt carrier 10 having forward facing shoulders 30 and 31 preceding backwardly extending corridor 32. In this view shoulders 31 and 30 are engaged by rollers 18 and 19, respectively, thereby preventing movement of them and their members 14 and 12 into corridor 32.

Figure 6:
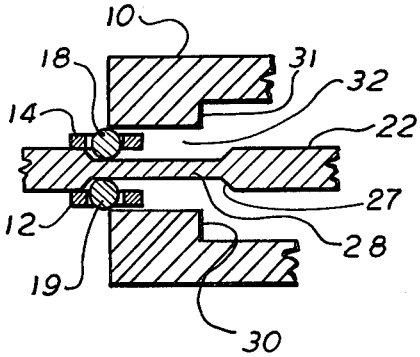
FIG. 6 is a sectional view illustrating relative motion between the components of FIG. 5.

FIG. 6 is a view similar to that of FIG. 5 except that depression 28 of rod 22 has received rollers 18 and 19, allowing them to move inwardly and pass through corridor 32.

To facilitate an understanding of the principles associated with the above apparatus, its operation will be briefly described.

At the beginning of the charging cycle, charger block 16 is full forward and held in that position by the return spring 34. Some overtravel is provided the charger block so as to allow the motor (not shown) actuating the drive chain 20 to start without the added load of the bolt carrier. When the drive chain is actuated, it pulls back the charger block (which is maintained upright by suitable means), whereby the rollers 18 and 19 engage the shoulders 31 and 30 of the bolt carrier and pull the carrier rearward against the conventional return compression spring 17 around guide rod 27 to the position shown in FIG. 4, where it is about to engage sear 24.

Figure 7:
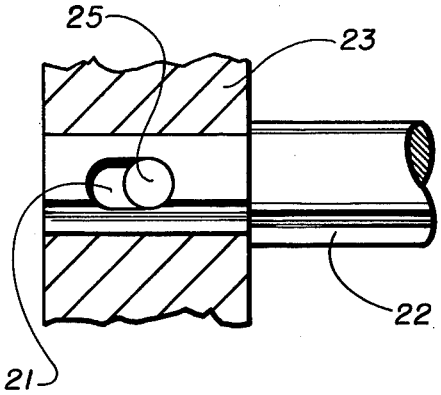
FIGS. 7 and 8 are fragmentary sectional views showing extreme travel positions of the charger guide rod.
Figure 8:
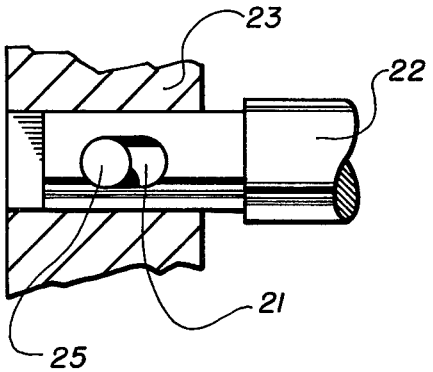

The condition of rollers 18 and 19 under these circumstances is illustrated in FIG. 5. As shown therein, rod 22 outwardly forces rollers 18 and 19 so that they engage shoulders 31 and 30, respectively, of bolt carrier 10. Consequently, drive chain 20 (FIG. 4) is able to pull backwardly carrier 10 along its guide rod 27 until the forward face of projection 26 of bolt carrier 10 passes sear 24. At this point rollers 18 and 19 reach the depression 28 and are cammed by the bolt carrier and enter the forward end 27 of depression 28, which allows the rollers to disengage the bolt carrier. The sear will then hold the bolt carrier while the charger block and its rollers continue to travel through depression on 28 until the charger motor stops (FIG. 6). During these operations, the rod 22 is forced backward the length of the slot 21 to pin 25 in frame 23, to the position shown in FIG. 7. The charger block is then released, and is moved forward along the rod 22 by the force of the return spring 34 until the rollers 18 and 19 impact the forward end 27 of the depression 28 on rod 22. At this point there is insufficient space for the rollers to pass outward along the forward end 27 of the depression; however the energy of the return spring imparted to the charging block then forces by such impact the guide rod 22 forward the length of the slot cut in the rod, as shown in FIG. 8. This movement of rod 22 allows the rollers sufficient room to be cammed out of the forward end 27 of the depression, whereupon the charge block is free to move to its full forward position, thus completing the charging cycle.

It is to appreciated that various modifications may be implemented with respect to the above preferred embodiment. For example the illustrated rollers may be retained within their blocks by trunions or by the limited clearance within the weapon. Also, instead of rollers, ball bearings or non-rolling members designed to slide across an elongated cam can be used. It is also expected that the charging block may in some embodiments be a device existing on only one side of the rod and having only one key or roller. It is also expected that numerous mechanical devices may be employed to cause a reciprocation of the charging block in place of the illustrated springs and chains. While the charging block shown herein can engage a shoulder or move through a corridor in a bolt carrier, in other emodiments, the charging blocks may engage the carrier in different manners. It is also expected that the components illustrated herein may be fabricated from metals or other materials depending upon the desired strength, weight, durability, speed etc.

Obviously, many modifications and variations of the present invention are possible in light of the above teachings. It is therefore to be understood that within the scope of the appended claims this invention may be practiced otherwise than as specifically described.

What is claimed is:

1. A charger for a bolt carrier of a weapon, said carrier having a forward facing shoulder, said charger comprising:

a rod having a longitudinal depression mounted in said weapon;

a charging block slidably mounted about said rod and having a lateral passage reaching said rod; and a key mounted in said lateral passage and operable to engage said shoulder, said key being inwardly moveable upon reaching said depression of said rod to disengage said shoulder.

2. A charger according to claim 1 wherein said key comprises a cylindrical roller.

3. A charger according to claim 1 wherein said block comprises:

a pair of spaced members each having a lateral opening reaching said rod.

4. A charger according to claim 3 wherein said key comprises a pair of rollers each separately mounted in a corresponding one of said spaced members.

5. A charger according to claim 1 wherein said block comprises a saddle-shaped member having a pair of opposing openings; and a pair of rollers each mounted in different corresponding one of said openings.

6. A charger according to claim 5 further comprising:

a drive chain attached to said block for backwardly urging it.

7. A charger according to claim 1 wherein said bolt carrier includes a sear for engaging said carrier, said depression being positioned to allow travel of said block and key after said sear engages said carrier.

8. A charger according to claim 7 further comprising: resilient means mounted about said rod for fowardly urging said charging block.

9. A charger according to claim 8 wherein said resilient means comprises a helical compression spring encircling said rod.

10. A charger according to claim 7, 8, or 9 wherein said rod comprises means which permit forward and rearward movement of the rod sufficient to enable said key to move out of said depression when said bolt carrier is engaged by said sear.

* * * * *